United States Patent [19]

Langen et al.

[11] 4,221,321

[45] Sep. 9, 1980

[54] PAPERBAG HAVING ARTICULATED HANDLE

[75] Inventors: Marinus J. M. Langen, Rexdale; Edgars H. Strauss, Toronto, both of Canada

[73] Assignee: H. J. Langen & Sons Ltd., Toronto, Canada

[21] Appl. No.: 28,532

[22] Filed: Apr. 9, 1979

[51] Int. Cl.[3] ..... B31B 1/86; B65D 33/06

[52] U.S. Cl. ..... 229/54 R; 93/35 H; 206/390; 229/55

[58] Field of Search ..... 229/52 B, 52 AC, 54 R, 229/55; 93/35 H; 206/390

[56] References Cited

U.S. PATENT DOCUMENTS 3,141,600 7/1964 Rosenthal ..... 229/55

*Primary Examiner*—Allan N. Shoap

*Attorney, Agent, or Firm*—Fetherstonhaugh & Co.

[57] ABSTRACT

A bag having handles, a roll stock suitable for use in manufacturing the bag and a method of manufacturing the bag are described herein. The bag comprises a plurality of side walls which include a pair of handle forming portions disposed opposite one another, each handle forming portion having elongated flaps extending downwardly from each end thereof which are secured in an overlying relationship with respect to the side wall panels on which the handle is located. The roll stock from which the bag is manufactured consists of a plurality of bag forming portion serially connected to one another to form an elongated web. Portions of the web are severed from the side wall forming panels along lines which extend outwardly from each side of the handle to form a pair of elongated flaps, the elongated flaps are folded along their connection with the handle forming portion to extend in an overlying relationship with respect to the side wall panels and are secured to the side wall panels to form a reinforced connection between the handle forming portion and the side wall panels of the bag.

20 Claims, 8 Drawing Figures

PAPERBAG HAVING ARTICULATED HANDLE

FIELD OF INVENTION

This invention relates to the manufacture of bags which incorporate a carrying handle.

PRIOR ART

Paper bags have long been used for the packaging of merchandise such as grocery items and used in very large quantities for this purpose. The absence of a handle for use in carrying the conventional paper bag has made the use and handling of these conventional paper bags very difficult.

While numerous techniques may easily be employed to secure or to construct a bag so that it incorporates a handle, the commercial success of paper bags in the packaging of groceries is to a large extent based on the very low cost of these items. To date, no satisfactory construction or method of forming a reinforced handle in a bag made from paper or the like, has been proposed which will make a satisfactory handle available without substantially increasing the cost of the individual bag units.

The present invention overcomes the difficulties of the prior art described above and provides a simple and efficient method of constructing a bag which incorporates a handle structure.

In my copending application Ser. No. 910,737 filed May 30, 1978, I have described a method and apparatus for constructing a bag from a continuous web of bag forming material such as paper or high density polyethylene or the like which has a sufficient rigidity to be self-supporting when in an open configuration. This method and apparatus may be used to convert a bag forming web in which a handle has been preformed as described hereinafter to the required bag configuration and for this reason the bag forming machine of the prior application is not described herein.

SUMMARY OF INVENTION

According to one aspect of the present invention, a bag which is closed at one end comprises a plurality of side wall panels extending upwardly from the closed end, the side wall panels having an upper edge, a pair of handle forming portions at said upper edge and disposed opposite one another, a hand opening formed in each handle forming portion, a pair of elongated flaps secured to and disposed at opposite ends of said handle forming portion, said elongated flaps extending downwardly from the handle forming portion to which they are secured and being secured in an overlying relationship with respect to said side wall panels to form handle reinforcing straps.

According to a further aspect of the present invention, a roll stock for use in manufacturing a bag comprises a plurality of bag forming portions serially connected to one another to form an elongated web, each bag forming portion comprising a plurality of wall forming panels connectible to form a bag which is closed at one end, said wall forming panels including side wall forming panels having a marginal edge portion which includes a pair of handle forming portions arranged to be disposed opposite one another when a bag is formed from said bag forming portion, portions of said marginal edge portions being severed from said side panels along lines which extend outwardly from each side of each handle forming portion to form a pair of elongated flaps connected to each handle forming portion, said elongated flaps being folded along their connection to the handle forming portions to extend in an overlying relationship with respect to said side wall panels, said elongated flaps being secured with respect to said side wall panels to form a reinforced connection between the handle forming portion and the side panels of the bag.

According to another aspect of the present invention, a method of making a bag from longitudinally elongated roll stock which has a pair of oppositely disposed longitudinally extending side edges, said roll stock serving to provide a plurality of bag forming portions serially connected to one another, each bag forming portion including a plurality of wall forming panels, including side and bottom wall forming panels, said side wall forming panels having a pair of upper edges spaced a substantial distance from one another, each upper edge having a handle forming portion located thereon, comprises the steps of cutting the web on opposite sides of each handle forming portion to form a pair of elongated flaps connected to each handle forming portion and extending laterally therefrom along its associated upper edge portion, folding each elongated flap along its connection to its handle forming portion to extend inwardly from its handle forming portion in an overlying relationship with respect to its adjacent side wall panel and securing said flaps in said overlying relationship to form a reinforced connection between the handle forming portions and the adjacent side panel, forming a hand opening in each handle forming portion, folding said side and bottom wall forming panels to a bag configuration and securing them in the bag configuration, and severing each bag forming portion from said roll stock.

According to yet another aspect of the present invention, there is provided in a method of forming a bag from longitudinally elongated roll stock which has a pair of oppositely disposed longitudinally extending side edges, said roll stock serving to provide a plurality of bag forming portions serially connected to one another, each bag forming portion including a plurality of wall forming panels including side and bottom wall forming panels, said side wall forming panels having a pair of upper edges spaced a substantial distance from one another, each upper edge portion including a handle forming portion, a method of forming a reinforced handle comprises the steps of cutting the web on opposite sides of each handle forming portion to form a pair of elongated flaps connected to each handle forming portion and extending laterally therefrom along its associated upper edge portion, folding each elongated flap along its connection to its handle forming portion to extend inwardly from its handle forming portion in an overlying relationship with respect to its adjacent side wall panel and securing said flaps in said overlying relationship to form a reinforced connection between the handle forming portions and the adjacent side panel.

PREFERRED EMBODIMENT

The invention will be more clearly understood after reference to the following detailed specification read in conjunction with the drawings, wherein.

Figure 1:
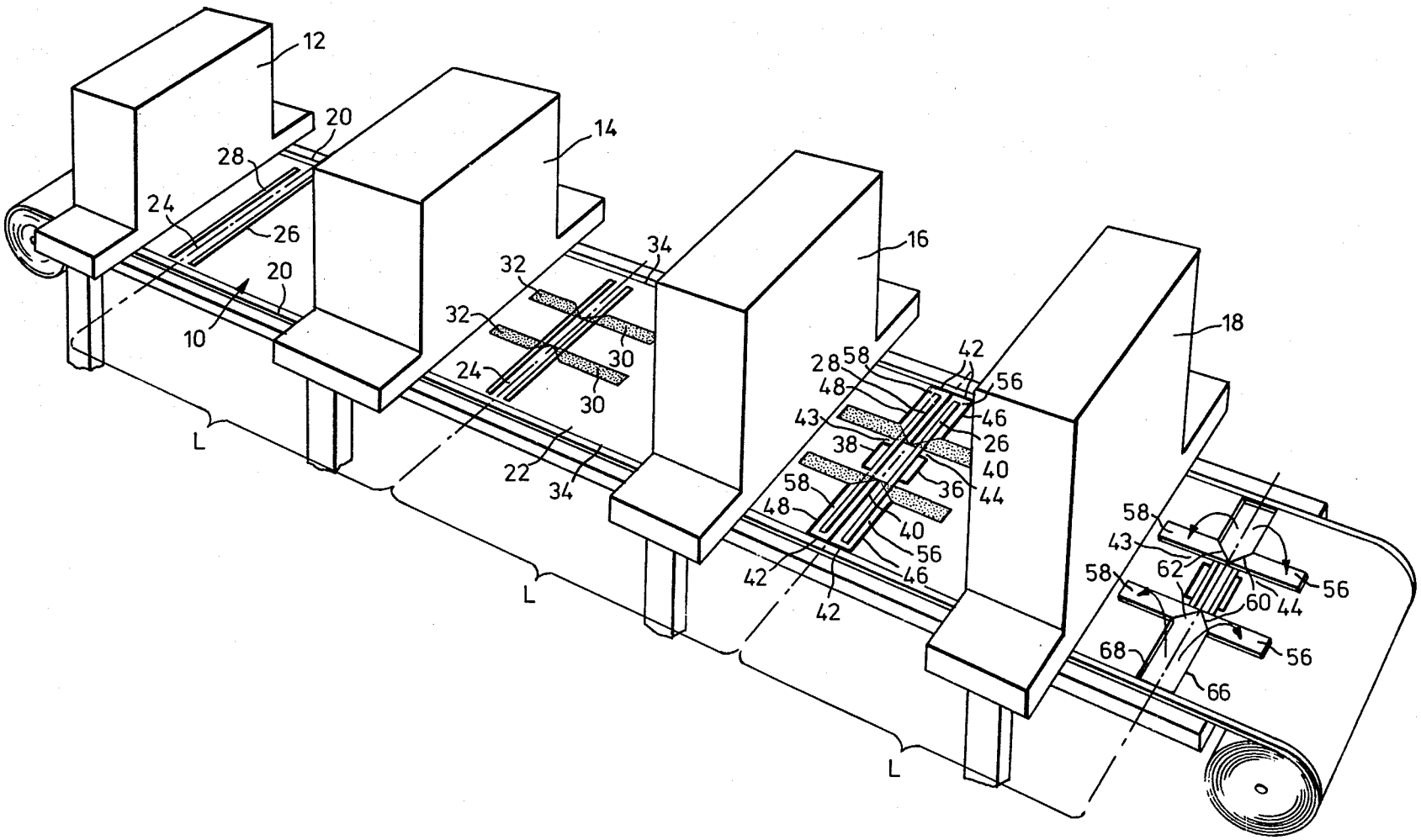
FIG. 1 is a pictorial diagrammatic view illustrating the successive steps in the forming of a reinforced handle in a web of bag forming material.

With reference to FIG. 1 of the drawings, the reference numeral 10 refers generally to a web of bag forming roll stock such as paper, high density polyethylene or the like. In the forming of the reinforced handle, the web passes through reinforcing tape applying station 12, adhesive applying station 14, cutting station 16 and folding station 18. The web 10 has a pair of oppositely disposed side edges 20 which, as will be described hereinafter, remain continuous and uninterrupted during each of the handle forming operations thereby to facilitate the passage of the web through the various handle forming stations and through the subsequent bag forming operations.

The web 10 provides a plurality of bag forming lengths 22, each of which has a length L extending between successive broken lines 24 illustrated in FIG. 1 of the drawings.

In the reinforcing tape applying station 12, two lengths of reinforcing tape 26 and 28 are applied to the upper face of the web 10 and extend transversely thereof. The reinforcing tapes 26 are uniformly spaced one on either side of the broken line 24 so that the tape 26 will subsequently be incorporated in one bag and the tape 28 incorporated in the next following bag. The reinforcing tapes 26 are preferably made from one of the readily available adhesive strapping tapes of the type which are reinforced with polyester filaments or the like and have a high tensile load capacity. A suitable example of such a plastic adhesive tape is that sold by Canadian Technical Tape Ltd. and identified by the trade mark TUCK TAPE. An alternative tape is a hot melt tape which must be heated to be secured to the web, an example of a suitable tape of this type is SESAME BRO730 (Trade Mark) manufactured by Sesame Industries Limited.

In the adhesive applying station 14, an adhesive coating is applied to the coated areas 30 and 32 arranged on opposite sides of the broken line 24. An adhesive coating is also preferably applied to narrow bands 34 disposed adjacent the longitudinal side edges of the web. The adheisve coating is selected so as to be compatible with the material from which the web is formed. The coating applied to the narrow bands 34 is preferably of a cohesive-adhesive type such that a bond will only be formed when adhesive-to-adhesive contact is established. It will be noted that similar cohesive-adhesive bands of adhesive coating are applied to the underside of the web as will be apparent from FIG. 2 of the drawings.

In the cutting head 16, the web is cut along U-shaped cut lines 36 and 38 arranged inwardly from reinforcing tapes 26 and 28 respectively. The web is also cut along cut lines 40 which extend transversely of the web from a point spaced laterally outwardly from the adjacent cut lines 36 to 38 and which terminate at a point spaced inwardly from the side edges of the web. Cut lines 42 extend longitudinally of the web on each side of the cut line 40 to cut lines 46 and 48. The cut lines 40, 42 and 46 form a pair of elongated flaps 56 which project laterally outwardly from a handle forming portion 44 located centrally therebetween. Similarly the cut lines 40, 42 and 48 form a pair of elongated flaps 58 which project laterally outwardly from a handle forming portion 43 located centrally therebetween.

In the folding station 18 the flaps 56 and 58 are folded along fold lines 60 and 62 which form the connection with the handle forming portions 44 and 43 of the web. The flaps 56 and 58 are secured in the folded relationship in which they extend substantially perpendicular to the edges 66 and 68 formed along the cut lines 46 and 48 respectively. The edges 66 and 68 subsequently form the upper edges of the side wall panels of the bag.

In the embodiment illustrated in FIG. 1, the roll stock is rewound into a coil form after the flaps 56 and 58 have been folded and secured in the folded position as described above. It will, however, be understood that the web may be fed directly to a bag forming machine. It is, however, anticipated that the roll stock will be preformed with the handle reinforcements as described above and rewound into a roll stock so as to be available for distribution to a number of bag forming machines and in particular to bag forming machines incorporated in check-out counters of retail marketing outlets as described in the applicant's copending application Serial No. 958,429 filed November 7, 1978.

Figure 2:
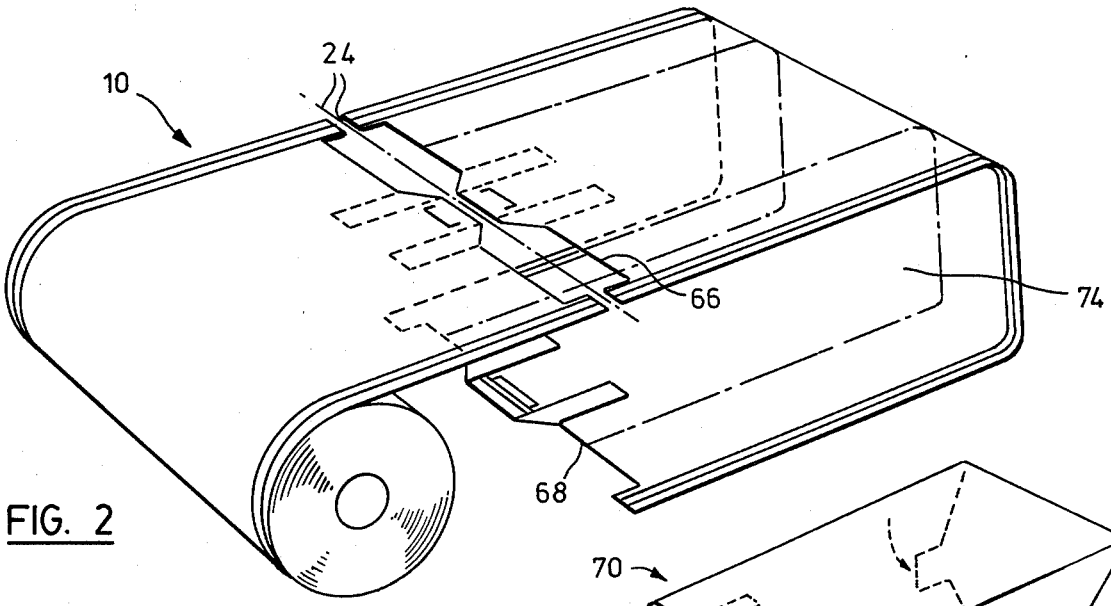
FIG. 2 is a pictorial view illustrating a first step in the forming of the web to a bag configuration.
Figure 3:
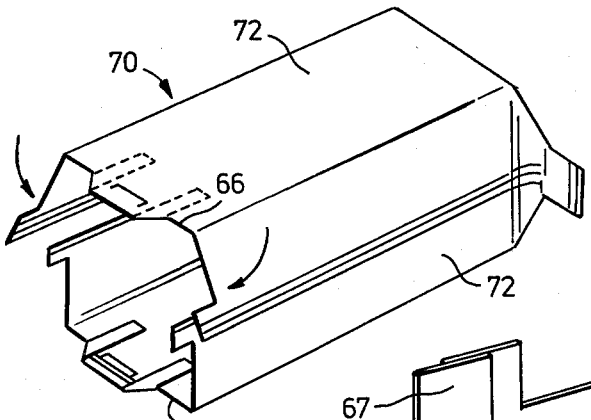
FIG. 3 is a pictorial view illustrating the second step in the forming of the web to the bag configuration.
Figure 4:
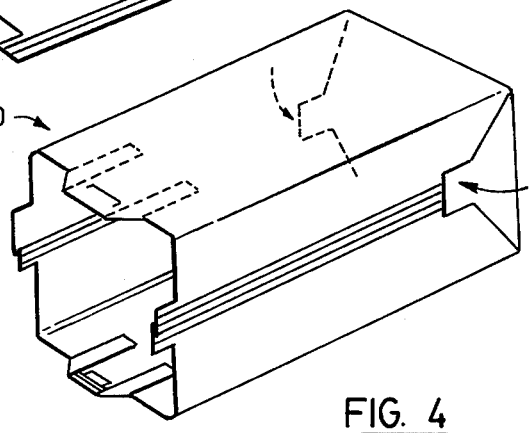
FIG. 4 is a pictorial view similar to FIG. 3 showing the final step in the formation of the bag.
Figure 5:
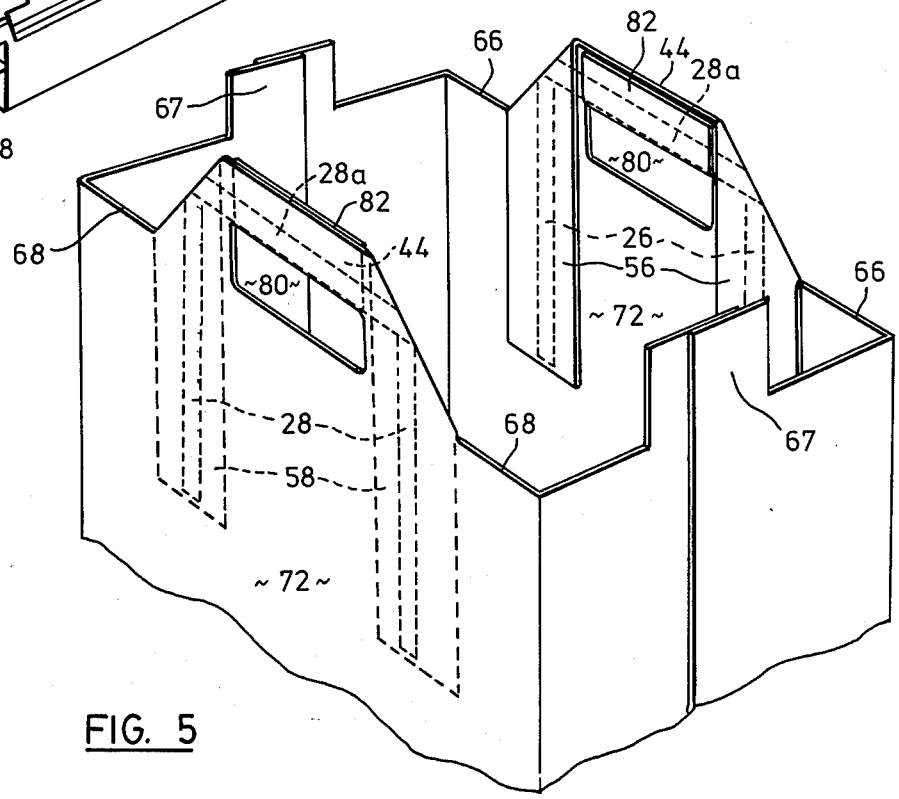
FIG. 5 is an enlarged detailed view of the upper end of a bag in an open configuration illustrating the shape and configuration of the reinforced handle portion.

In order to form a bag from a web in which the handles have been preformed, the web 10 is unwound from a coil as shown in FIG. 2 and guided around a forming mandrel in the manner described in copending application Ser. No. 910,737. The web is severed along the broken line 24 and progressively folded as shown in FIGS. 3 and 4 to the required bag configuration. When completed the bag, which is generally identified by the reference numeral 70 in FIGS. 3 and 4, consists of a plurality of side walls 72 and 74 extending upwardly from a closed end formed by an end wall panel 74 (FIG. 2). The edges 68 and 66 formed at the cut lines 48 and 46 respectively in the forming of the elongated flaps form the upper edges of the bag. As shown in FIG. 5 of the drawings, the elongated flaps 56 and 58 extend downwardly in a face-to-face overlying relationship with respect to the inner face of the side walls of the bag and the reinforcing tapes 26 and 28 are located between the flaps 56 and 58 and their underlying side wall panels 72. The reinforcing tapes 26 are preferably located centrally of the width of the flaps 56 and 58 so that a portion of each flap is secured to its underlying side wall on either side of the reinforcing tape.

It will be noted that a hand opening 80 is formed in each handle forming portion by folding the flap 82, which is formed by the cut lines 36 and 38, upwardly to sandwich the transversely extending portion 28*a* of the tape between the flap 82 and the adjacent handle forming portion 44. By folding the flap 82 over the edge of the reinforcing tape 82, the width of the handle portion is increased along the edge which is manually engaged in use and this reduces the likelihood of this edge injuring the hand of the user when the bag is carried by the handle.

It will be noted that the step of preforming handle portions in the continuous web can be achieved without disrupting the continuity of the longitudinally extending side edges of the web. This is particularly important when it is necessary to feed the web to a subsequent bag forming operation before individual bag forming lengths are severed from the web.

Figure 7:
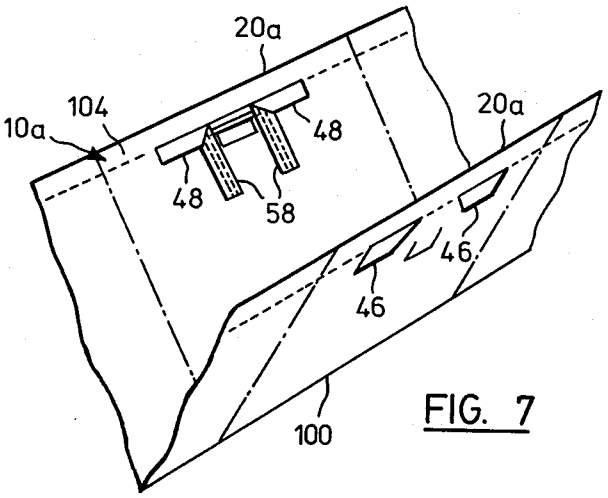
FIG. 7 is a pictorial view of a partially folded web illustrating an alternative method of forming a bag.
Figure 8:
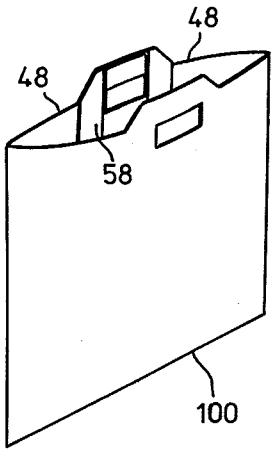
FIG. 8 is a pictorial view of a bag constructed by the method illustrated in FIG. 7.
Figure 6:
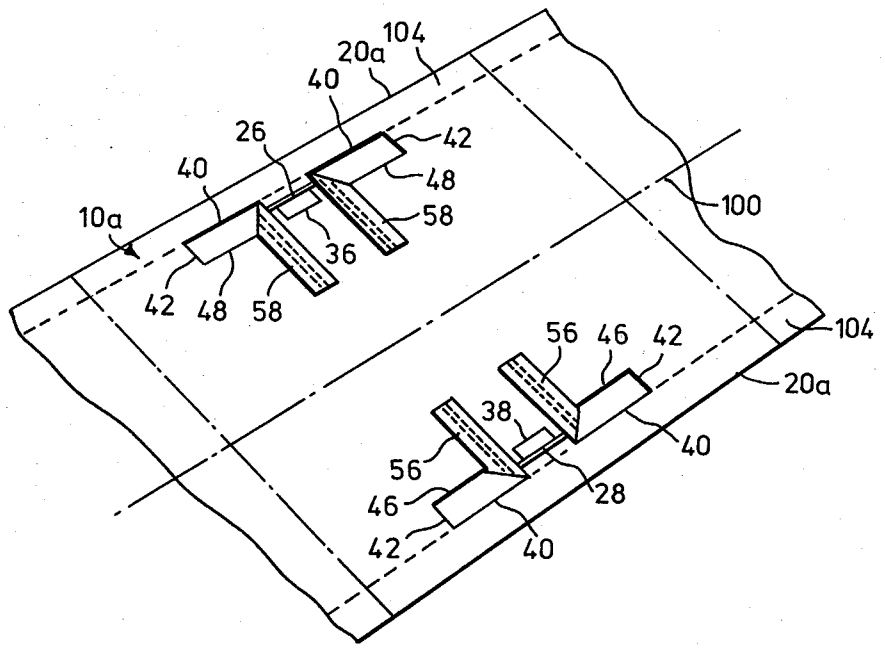
FIG. 6 is a pictorial view of a web in which the handle reinforcement panels have been reoriented to extend longitudinally of the web.

Various modifications of the present invention will be apparent to those skilled in the art. One such modification is illustrated in FIG. 6 of the drawings wherein the reinforcing handle structure is provided at locations disposed opposite one another and adjacent the longitudinal side edges 20*a* of a web 10*a*. Again, the handles are preferably formed so as to be spaced inwardly from the longitudinal edges 20*a* so as to avoid interruption in the continuity of the marginal edges. In FIGS. 6, 7 and 8, like numerals have been applied to like parts of the handle reinforcement.

It will be apparent to the individual skilled in the art that the web with the reinforced handle construction formed thereon may be formed to a suitable bag configuration by a method and apparatus other than that described above and in copending application Ser. No. 910,737. In this respect, FIGS. 6, 7 and 8 show an alternative form of construction wherein subsequent to the forming of the reinforced handle, the web 10*a* is folded along a fold line 100 and secured along side edges 102 by a suitable adhesive or bonding technique, the marginal edge portion 104 having been removed by a suitable slitting mechanism or the like prior to or subsequent to the forming of the bag.

From the foregoing it will be apparent that the present invention provides a simple and efficient method of forming a reinforced handle in a bag which is preferably made from paper stock of the type conventionally used in the manufacture of bags used for packaging merchandise such as groceries and the like.

Various other modifications of the present invention will be apparent to those skilled in the art without departing from the scope of the invention. For example, the ears 67 (FIG. 5) which are formed as a result of the maintenance of continuity of the marginal edges of the web may be severed by the introduction of an additional cutting operation after the bag is formed. In addition, it will be apparent that while in many applications as previously indicated it is extremely important to provide for the continuity of the longitudinal side edges of the web, it is possible to form the reinforced handle structure in a web in which the said edges are discontinuous. This may be achieved in a bag configuration of the type illustrated in FIG. 6 wherein marginal edge portion 104 is not provided and in which a continuation of the edge identified by the reference numeral 40 in FIG. 6 forms the longitudinal side edges of the web 10*a*.

What I claim as my invention is:

1. A bag comprising a plurality of side wall panels extending upwardly from a closed end, the side wall panels having an upper edge, a pair of handle forming portions each formed unitarily with one of said side wall panels and located at said upper edge and disposed opposite one another, a hand opening formed in each handle forming portion, a pair of elongated flaps secured to and disposed at opposite ends of said handle forming portion, said elongated flaps extending downwardly from the handle forming portion to which they are secured and being secured in an overlying relationship with respect to said side wall panels to form handle reinforcing straps.

2. A bag as claimed in claim 1 including a reinforcing tape associated with each handle forming portion, each reinforcing tape extending along one of said handle forming portions above its associated hand opening and downwardly with said elongated flaps to be secured with respect to said side wall panels to further reinforce said handles.

3. A bag as claimed in claim 2 wherein said elongated flaps extend downwardly from a fold line at which they are integrally connected to their associated handle forming portions.

4. A bag as claimed in claim 2 wherein said reinforcing straps are laminated between said elongated flaps and the underlying portions of said side wall panels.

5. A bag as claimed in claim 2 wherein each handle opening has an upper edge and a handle flap hingedly connected to said upper edge, said handle flap being foldable along said upper edge to sandwich said reinforcing tapes therebetween and space the reinforcing tape from the hand opening.

6. A bag as claimed in claim 1 wherein said flaps extend downwardly from their associated handle forming portion at right angles to the upper edge of the side wall panels.

7. A bag as claimed in claims 1, 2, 3, 4, 5, or 6 when made from paper stock.

8. A roll stock for use in manufacturing a bag comprising a plurality of bag forming portions serially connected to one another to form an elongated web, each bag forming portion comprising a plurality of wall forming panels connectible to form a bag which is closed at one end, said wall forming panels including side wall forming panels having a marginal edge portion which includes a pair of handle forming portions arranged to be disposed opposite one another when a bag is formed from said bag forming portion, each handle forming portion having a hand opening therein, portions of said marginal edge portions being severed from said side wall forming panels along lines which extend outwardly from each side of each handle forming portion to form a pair of elongated flaps connected to each handle forming portion, said elongated flaps being folded along their connection to the handle forming portions to extend in an overlying relationship with respect to said side wall panels, said elongated flaps being secured with respect to said side wall panels to form a reinforced connection between the handle forming portion and the side wall forming panels of the bag.

9. A roll stock as claimed in claim 8 having a pair of substantially uninterrupted straight side edges, said elongated flaps being struck from said web at points spaced inwardly from said side edges.

10. A roll stock as claimed in claim 8 wherein said bag forming portions are oriented so that the handle forming portions thereof are spaced from one another in a direction of the longitudinal extent of said web and the handle forming portions of one bag forming portion are serially connected to the handle forming portions of the next adjacent bag forming portion.

11. A roll stock as claimed in claim 8 wherein said lines along which said roll stock is cut to form said elongated flaps extend transversely of the longitudinal extent of the web and terminate inwardly from the side edges of the web.

12. A roll stock as claimed in claim 8 wherein a reinforcing tape extends along said marginal edge portion above each of said hand openings and inwardly from their associated handle forming portions.

13. A roll stock as claimed in claim 8 wherein the stock is a paper stock.

14. A method of making a bag from longitudinally elongated roll stock which has a pair of oppositely disposed longitudinally extending side edges, said roll stock serving to provide a plurality of bag forming portions serially connected to one another, each bag forming portion including a plurality of wall forming panels, including side and bottom wall forming panels, said side wall forming panels having a pair of upper edges spaced a substantial distance from one another, each upper edge having a handle forming portion located thereon, comprising the steps of:

(i) cutting the web on opposite sides of each handle forming portion to form a pair of elongated flaps connected to each handle forming portion and extending laterally therefrom along its associated upper edge portion;

(ii) folding each elongated flap along its connection to its handle forming portion to extend inwardly from its handle forming portion in an overlying relationship with respect to its adjacent side wall panel and securing said flaps in said overlying relationship to form a reinforced connection between the handle forming portions and the adjacent side panel, (iii) forming a hand opening in each handle forming portion;

(iv) folding said side and bottom wall forming panels to a bag configuration and securing them in the bag configuration; and (v) severing each bag forming portion from said roll stock.

15. A method of making a bag as claimed in claim 14 further including the step of;

(i) applying a reinforcing tape to the handle forming portions and their adjacent elongated flaps to form a reinforcement bridging the connection between the handle forming portions and the flaps.

16. A method of making a bag as claimed in claim 15 wherein the reinforcing tape is applied before the flaps are folded to overlie the side walls and are thereafter folded with the flaps as aforesaid.

17. A method of making a bag as claimed in claim 14 wherein said web is cut along said first cut lines which extend transversely of the longitudinal extent thereof and along second cut lines spaced inwardly from said longitudinally extending side edges of the web to form said elongated flaps without interrupting the continuity of the longitudinally extending side edges of the web.

18. In a method of making a bag from longitudinally elongated roll stock which has a pair of oppositely disposed longitudinally extending side edges, said roll stock serving to provide a plurality of bag forming portions serially connected to one another, each bag forming portion including a plurality of wall forming panels including side and bottom wall forming panels, said side wall forming panels having a pair of upper edges spaced a substantial distance from one another, each upper edge portion including a handle forming portion, a method of forming a reinforced handle comprising the steps of;

(i) cutting a hand opening in each handle forming portion, (ii) cutting the web on opposite sides of each handle forming portion to form a pair of elongated flaps connected to each handle forming portion and extending laterally therefrom along its associated upper edge portion, (iii) folding each elongated flap along its connection to its handle forming portion to extend inwardly from its handle forming portion in an overlying relationship with respect to its adjacent side wall panel and securing said flaps in said overlying relationship to form a reinforced connection between the handle forming portions and the adjacent side panel.

19. A bag comprising a plurality of side wall panels extending upwardly from a closed end, the side wall panels having an upper edge, a pair of handle forming portions at said upper edge and disposed opposite one another, a hand opening formed in each handle forming portion, a pair of elongated flaps secured to and disposed at opposite ends of said handle forming portion, said elongated flaps extending downwardly from the handle forming portion to which they are secured and being secured in an overlying relationship with respect to said side wall panels to form reinforcing straps, said elongated flaps extending downwardly from a fold line at which they are integrally connected to their associated handle forming portions.

20. A bag comprising a plurality of side wall panels extending upwardly from a closed end, the side wall panels having an upper edge, a pair of handles at the upper edge disposed opposite one another, each handle comprising a manually engageable cross-bar portion having a hand opening formed therebelow and a pair of elongated flaps extending dowardly from opposite ends of the cross-bar portion, said flaps being secured in an overlying relationship with respect to their associated side panel, each handle having a reinforcing tape secured to and extending continuously along its cross-bar portion and its pair of elongated flaps to be secured to said side wall panels and the elongated flaps to reinforce said handles.

* * * * *